United States Patent [19]

Gardiner et al.

[11] Patent Number: 4,749,082

[45] Date of Patent: Jun. 7, 1988

[54] KNIFE TRANSPORT/DISPLAY PACKAGE

[75] Inventors: Mark L. Gardiner, New York; James Economos, Kingston, both of N.Y.

[73] Assignee: Imperial Schrade Corp., New York, N.Y.

[21] Appl. No.: 859,994

[22] Filed: May 5, 1986

[51] Int. Cl.[4] ..... B65D 85/24; B65D 77/20

[52] U.S. Cl. ..... 206/349; 206/45.31; 206/315.11; 206/461; 206/471

[58] Field of Search ..... 206/349, 372, 373, 315.11, 206/45.31, 461, 462, 463, 464, 470, 471, 44.11, 352, 353, 379, 380, 385, 465, 467, 468, 469, 553

[56] References Cited

U.S. PATENT DOCUMENTS

| | | | |
|---|---|---|---|
| 857,767 | 6/1907 | Stephens | 206/349 |
| 1,719,681 | 7/1929 | Wiebusch | 206/349 |
| 2,682,950 | 7/1954 | Mercer et al. | 206/553 |
| 3,375,921 | 4/1968 | Ligon | 206/463 |
| 3,752,303 | 8/1973 | Foster | 206/470 |
| 3,869,043 | 3/1975 | Warner et al. | 206/385 |
| 3,990,578 | 11/1976 | Roeser | 206/45.31 |
| 4,091,927 | 5/1978 | Lunsford | 206/493 |
| 4,231,531 | 7/1980 | Rae | 206/463 |
| 4,319,684 | 3/1982 | Backman et al. | 206/464 |
| 4,499,353 | 2/1985 | Shields | 206/470 |
| 4,619,364 | 10/1986 | Czopor, Jr. | 206/470 |

FOREIGN PATENT DOCUMENTS

| | | | |
|---|---|---|---|
| 1242088 | 8/1971 | United Kingdom | 206/471 |

*Primary Examiner*—Jimmy G. Foster

*Attorney, Agent, or Firm*—Kirschstein, Kirschstein, Ottinger & Israel

[57] ABSTRACT

A package for transporting and displaying a knife having an exposed blade and a handle includes handle-confining and blade-confining walls for respectively bounding handle and blade compartments having complementary contours to that of the handle and exposed blade, respectively, for resisting relative displacement between the knife and the package during transport and display. Ribs are formed integrally with the package for steadying the blade and the knife, and for stiffening the overall package.

19 Claims, 4 Drawing Sheets

FIG. 8
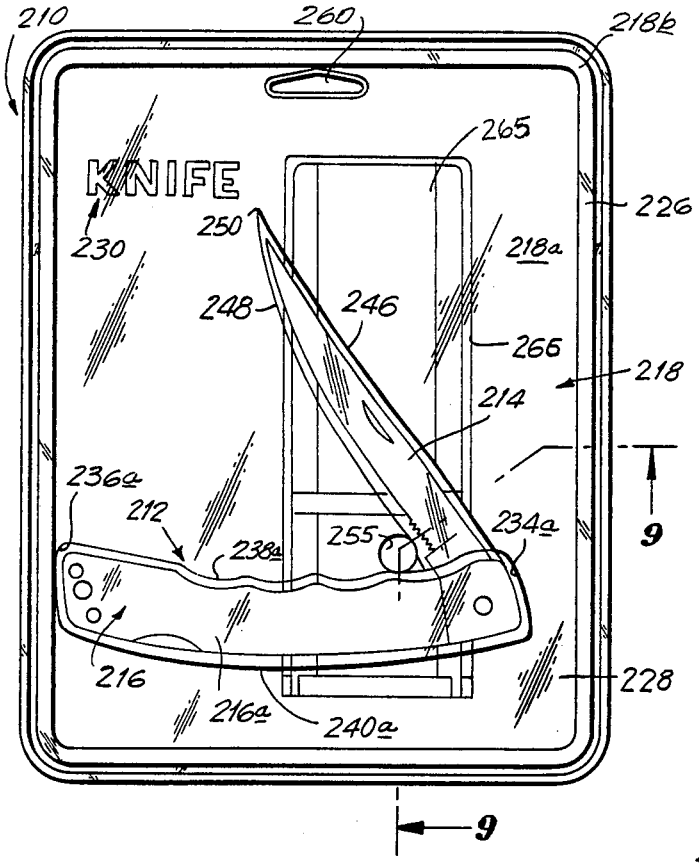
FIG. 9
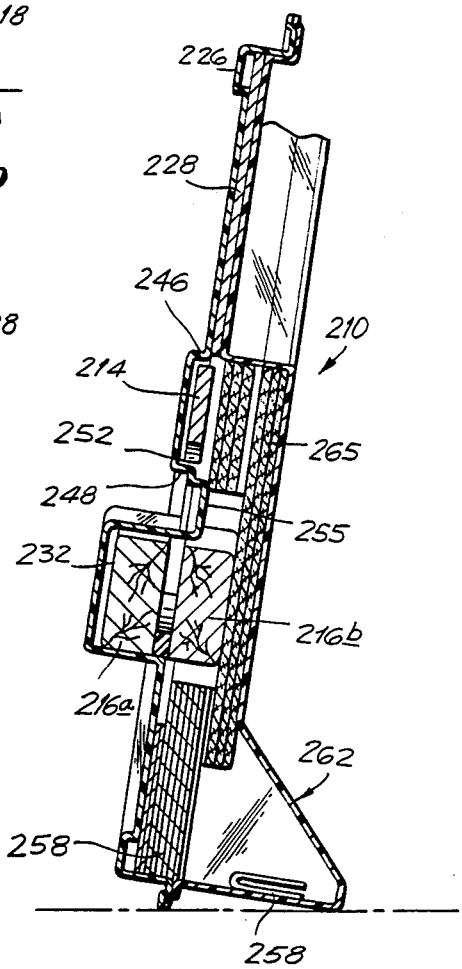
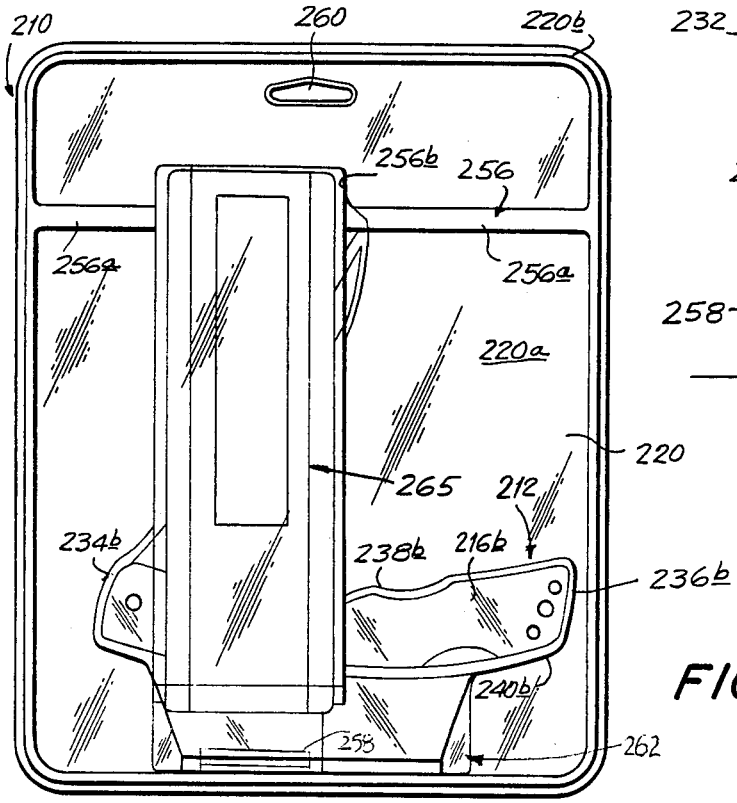
FIG. 10

KNIFE TRANSPORT/DISPLAY PACKAGE

BACKGROUND OF THE INVENTION

1. Field of the Invention

This invention generally relates to a package for transporting and displaying a knife having an exposed blade and, more particularly, to a package which is resistant to nicks, punctures, cuts and analogous damage caused by the exposed blade during transport and display.

2. Description of the Prior Art

Folding-blade knives of the type wherein a cutting blade is mounted on a handle for pivoting movement between closed and open positions in which the cutting edge of the blade is concealed and exposed respectively relative to the handle, and rigid-blade knives of the type wherein the cutting blade is stationarily mounted on the handle, have often been sold in a non-packaged, loose, bulk manner. This has not proven to be altogether satisfactory because there are self-evident safety risks involved in having a purchaser handle the knife. Yet, many knife purchasers desire to inspect the cutting edge of the blade prior to purchase.

Nevertheless, in order to reduce the safety risks involved in permitting the purchaser to manipulate the knife at the point of sale, and thereby possibly cut himself, it has heretofore been proposed to enclose a folding knife with the blade in the closed position in blister card packaging of the type having a backing card usually made of heavy grade paper, and a plastic bubble-type overlay which enwraps the closed folding knife. Although blister card packaging is generally satisfactory for its intended purpose of minimizing purchaser handling of the knife, it does not permit the purchaser to inspect the cutting blade because the blade is concealed within the handle of the closed folding knife and cannot be manipulated short of destroying the packaging.

The prior art has also proposed the placement of both folding-blade and rigid-blade knives in gift boxes usually having covers which pivot open to reveal the knife therein. Such boxed knives are shipped in the closed position because, otherwise, manufacturers have appreciated that the exposed blade could penetrate and do damage to the box itself, particularly during rough handling and transport. Such boxed knives may be displayed in either the open or closed position, and may be freely handled by the purchaser. Gift-boxed knives have proven undesirable because they do not reduce the above-described safety hazards. Also, because the knives are shipped in the closed position to prevent damage to the box, the knives are typically opened at the point of sale by either the purchaser or the retailer to permit inspection. This is time-consuming for the retailer, particularly when a large inventory of gift-boxed knives have to be opened prior to display.

SUMMARY OF THE INVENTION

1. Objects of the Invention

It is a general object of this invention to overcome the aforementioned drawbacks of the prior art knife display packages.

It is another object of this invention to transport and display a knife having an exposed blade at all times without incurring damage to, and destroying, the structural integrity of the package in which the knife is transported and displayed.

It is a further object of this invention to provide a package for transporting and displaying a knife of the folding-blade or rigid-blade type wherein one or more knife blades are exposed at all times.

Still another object of this invention is to enable a purchaser to readily inspect both sides of the cutting blade of the knife without exposing the purchaser to risk of personal injury.

Yet another object of this invention is to provide a knife display package which is highly resistant to nicks, punctures, cuts and analogous damage caused by relative movement between the exposed blade and the package during such handling activities as transport, display and inspection.

Another object of this invention is to provide a tamper-resistant package which may be conveniently suspended on a support rod or hook, or supported on a generally horizontal support surface such as a counter top.

A further object of this invention is to provide a sturdy package which resists external bending, twisting or similar forces acting to cause relative displacement between the knife and the package.

A still further object of this invention is to provide a knife support package which is inexpensive to manufacture, simple in construction, long-lasting in use, and attractive in appearance.

2. Features of the Invention

In keeping with these objects, and others which will become apparent hereinafter, one feature of this invention resides, briefly stated, in a package for transporting and displaying a knife having an exposed blade and a handle, which knife can be of either the folding-blade type or the rigid-blade type. The package comprises a pair of synthetic plastic material shells having main shell portions spaced apart from each other to bound a space in which the knife with the exposed blade is received. The shells also have shell edge portions peripherally bounding the main shell portions, and peripherally sealed together to form a sealed package.

A generally planar insert, preferably constituted of heavy-grade paper, is mounted within the space between the main shell portions. Indicia relating to the knife may be provided on one or both sides of the insert.

Handle-confining walls are provided on at least one of the main shell portions, e.g. a front shell which is normally intended to face a viewer. The handle-confining walls are offset from the plane of the insert, and bound in said space a handle compartment having a complementary contour to that of the handle for closely confining the handle in the handle compartment. If the handle is composed of two parts, then, advantageously, the handle-confining walls are provided on both shell portions and extend in opposite directions relative to the plane of the insert so that each handle part can be snugly received within its own compartment.

Blade-confining walls are provided on at least one of the main shell portions, and preferably on the front shell. The blade-confining walls are offset forwardly from the plane of the insert, and bound in said space a blade compartment having a complementary contour to that of the exposed blade for closely confining the latter in the blade compartment.

A knife-receiving cutout is formed in, and extends through, the insert. The cutout has a complementary outline to that of the handle and the exposed blade.

The package also includes means for supporting the knife in a generally upright display condition. The supporting means may include a hang-up hole extending through the shells and the insert sandwiched therebetween. The hang-up hole accommodates with clearance a support rod such as a hook which is inserted through the hole for suspending the package in a vertical plane on the rod. In another advantageous embodiment, the supporting means may constitute a base integral with one of the shells, e.g. a rear shell which is normally intended to face away from the viewer. The base supportably displays the knife above a generally horizontal support surface such as a counter top.

At least one, and preferably both, of the main shell portions of the front and rear shells is light-transmissive. This feature enables the viewer to view the knife with the exposed blade for close inspection, as well as to simultaneously view the indicia provided on one or both sides of the insert in the display condition of the knife.

In accordance with this invention, the close confinement of the handle and the exposed blade between the shells resists relative displacement between the knife and the package during transport and display. This close confinement opposes damage to the package by the exposed blade so that a knife with an exposed blade can be transported and shipped in the very same package without requiring subsequent manipulation of the blade and without exposing the purchaser to risk of personal injury. In order to even further protect the purchaser from injury, as well as the structural integrity of the package, additional means are provided for resisting any external forces tending to effect relative displacement between the knife and the package. Such resisting means may advantageously include a rib integral with one of the shells, and preferably the rear shell, the rib extending in a transverse direction across the width of the exposed blade from one to the other lateral side of the package. One or more ribs can be so employed, each rib acting as a package stiffener for preventing the knife from being displaced from the aforementioned compartments.

Particularly in the case wherein a folding-blade knife is packaged, this invention further proposes that the resisting means include a stop integral with one of the shells, and projecting into the path of blade displacement. This stop serves as a lock, and prevents the folding blade from being moved between its closed and open positions, thereby serving as a further deterrent against knife displacement tending to destroy the packaging.

Another feature of this invention is embodied in providing a sheath for the knife in the same package which contains the knife. In an advantageous aspect, the sheath may be closely confined within a compartment which itself acts as a package stiffener.

The novel features which are considered as characteristic of the invention are set forth in particular in the appended claims. The invention itself, however, both as to its construction and its method of operation, together with additional objects and advantages thereof, best will be understood from the following description of specific embodiments when read in connection with the accompanying drawings.

BRIEF DESCRIPTION OF THE DRAWINGS

FIG. 8 is a front view of a knife transport/display package in accordance with still another embodiment of this invention;

FIG. 9 is an enlarged sectional view taken along line 9—9 of FIG. 8;

FIG. 10 is a rear view of the package of FIG. 8;

DETAILED DESCRIPTION OF THE PREFERRED EMBODIMENTS

Figure 1:
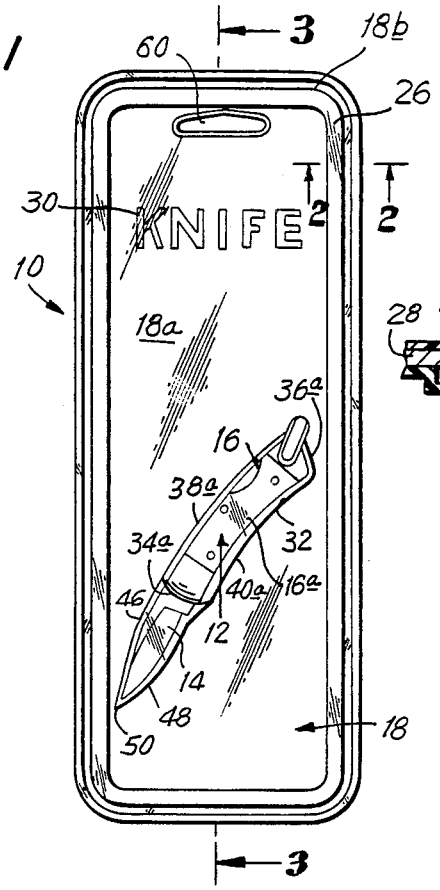
FIG. 1 is a front view of a knife transport/display package in accordance with one embodiment of this invention.
Figure 2:
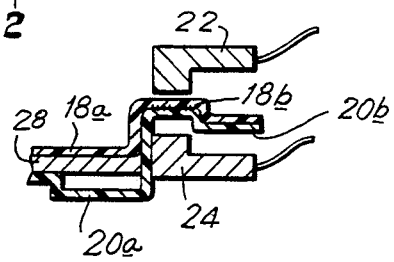
FIG. 2 is an enlarged sectional view taken along line 2—2 of FIG. 1, showing a preferred arrangement for heat-sealing the peripheral edge portions of the package.
Figure 3:
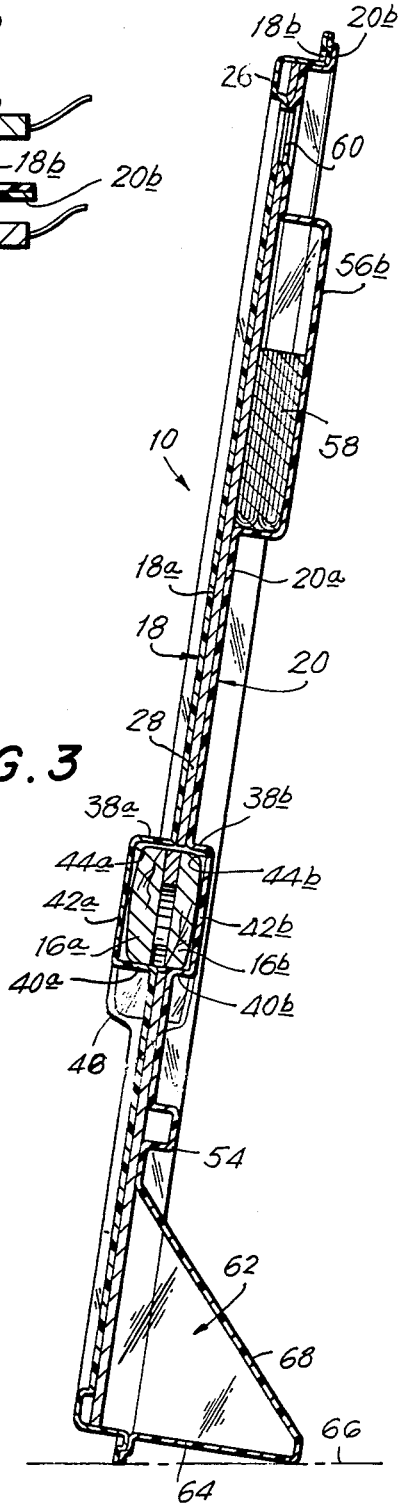
FIG. 3 is an enlarged sectional view taken along line 3—3 of FIG. 1.

Referring now to the drawings, and particularly to the first embodiment shown in FIGS. 1–4, reference numeral 10 generally identifies a package for transporting and displaying a knife 12 having an exposed blade 14 and a handle 16. The knife 12 is a folding blade pocket knife wherein the blade 14 is pivotably mounted on the handle 16 for swinging movement between a closed position in which the sharp cutting edge of the blade 14 is concealed within the handle, and an open position in which the blade cutting edge is exposed. As illustrated in FIG. 1, the knife 12 is fully opened, and the blade 14 is fully exposed as it is in its normally intended position of use. As best shown in FIG. 3, the handle 16 is comprised of a pair of handle parts **16*a*, 16*b* between which the blade 14** is movable.

The opened knife is mounted between a pair of synthetic plastic material shells 18, 20, each advantageously, although not necessarily, constituted of a light-transmissive, transparent material such as colorless polyvinyl chloride, so that the knife, and particularly the blade 14, may be visually inspected, but not handled, by a user through the shells. The shells 18, 20 have main shell portions **18*a*, 20*a* which are peripherally bounded by shell edge portions 18*b*, 20*b*. Each main shell portion is thin, e.g. 20 mils thickness, is generally planar, and has a rectangular shape. The main shell portions lie in mutually parallel planes closely adjacent each other over most of their surface areas, except in certain compartment-forming regions, for example, in the region of the knife 12. The main shell portions bound an interior space in which the opened knife is received. The edge portions 18*b*, 20*b* extend around all four sides of their respective main portions 18*a*, 20*a***, and are sealed together, preferably by a heat seal using radio frequency techniques.

As illustrated in FIG. 2, a pair of conventional radio frequency (RF) electrodes 22, 24 connected to an RF energy source are applied to opposite sides of the edge portions **18*b*, 20*b* which are already in contact with each other. An RF field is generated between the electrodes 22, 24 which heats up both contacting edge portions 18b, 20b** and causes them to fuse together. The electrodes may then be removed. The edge portions are pre-positioned in contact with each other prior to engagement with the RF electrodes and, for this purpose, the shells are pre-formed, preferably by vacuum-forming techniques, into the shapes shown in FIGS. 1–4.

For ease of description, shell 18, which is normally intended to face a purchaser, will hereinafter be referred to as the "front" shell, and shell 20, which is normally intended to face away from the purchaser, will hereinafter be referred to as the "rear" shell.

A raised border 26 peripherally surrounds front shell 18 inwardly of the edge portions 18b.

A generally planar insert 28, preferably constituted of heavy-grade paper, coated on one side, and having a thickness which can vary between six-point and fourteen-point board, is also mounted within the space between the shells 18, 20. Indicia 30 relating to the knife 12 may be provided on one or both sides of the insert 28. The indicia may be indicative of a trademark, descriptive information relating to the features of the knife, instructions for use, warranty information and, in short, any data deemed desirable to present to the purchaser. The indicia 30 provided on the front and/or rear surfaces of the insert are viewable through the transparent main portions 18a, 20a of the front and/or rear shells, respectively. The insert 28 engages the interior-facing surfaces of the main portions 18a 20a, and is, in effect, clamped therebetween so that the insert cannot move. A knife-receiving cutout 32 is formed in, and extends through, the insert 28. The cutout 32 has a complementary outline to that of the handle 16 and the exposed blade 14, so that the opened knife is closely received within the cutout.

Handle-confining walls are integrally formed on at least one, and preferably both, main shell portions of the front and rear shells. The handle-confining walls are offset from the plane of the insert 28, and include end walls 34a, 36a at opposite ends of the handle part 16a, and side walls 38a, 40a at opposite sides of the handle part 16a. The end walls 34a, 36a and the side walls 38a, 40a extend generally perpendicular to the plane of the insert 28, as wall as perpendicular to the plane of the main portion 18a. A base wall 42a extends generally parallel to the plane of the insert 28 and, together with the aforementioned end and side walls 34a–40a, bound a front handle compartment 44a in which the handle part 16a is closely confined. Similarly, end walls 34b, 36b at opposite ends of the handle part 16b, and side walls 38b, 40b at opposite sides of the handle part 16b, all extend generally perpendicular to the plane of the insert 28, as well as perpendicular to the plane of the main portion 18b. A base wall 42b extends generally parallel to the plane of the insert 28 and, together with the end and side walls 34b–40b, bound a rear handle compartment 44b in which the handle part 16b is closely confined.

The front 44a and rear 44b compartments together form a handle compartment whose contour closely matches that of the handle 16, so that the latter is snugly and tightly contained with little clearance therein. The handle 16 is symmetrically located on the package; that is, the handle part 16a extends forwardly of the insert 28 approximately the same distance as handle part 16b extends rearwardly of the insert in order to provide a better balance for the overall package.

Blade-confining walls are integrally formed on at least one of the main shell portions, and preferably on the front shell 18. The blade-confining walls are offset from the plane of the insert 28, and include side walls 46, 48 at opposite sides of the blade 14, and running respectively along the dull edge and the sharp cutting edge of the blade. Side walls 46, 48 extend generally perpendicular to the plane of the insert 28, as well as perpendicular to the main portion 18a. Side walls 46, 48 meet at a point adjacent the tip of the blade. Side walls 46, 48 merge with, and form a smooth continuation of, the side walls 38a, 40a, respectively, of the front handle compartment 44a. A base wall 50 extends generally parallel to the plane of the insert 28 and, together with the side walls 46, 48, bound a blade compartment 52. In contrast to the aforementioned handle compartment which is composed of a front handle compartment 44a and a rear handle compartment 44b, the relative thinness of the blade 14 only requires a single blade compartment 52 to contain the blade and, preferably, this compartment 52 projects forwardly of the front shell 18. The blade compartment 52 has a contour closely matching that of the blade 14, so that the latter is snugly and tightly contained with little clearance therein.

The snug fit of the handle 16 and the blade 14 in their respective compartments resists the tendency of the knife 12 from being displaced relative to the package during transport and display, as well as during any other handling of the package, e.g. during inspection by the purchaser. Hence, an opened knife can be shipped and displayed without incurring any damage to the structural integrity of the package by reason of the exposed blade nicking, puncturing, cutting or otherwise damaging the plastic packaging and/or the paper insert, and without incurring any personal injury.

In addition to the snug fit of the knife within the handle and blade compartments, additional means are provided for resisting external forces tending to effect relative displacement between the knife and the packaging. Sometimes during rough handling, the package is subjected to external bending and twisting forces about axes which extend lengthwise and widthwise of the package and, during such rough handling, the exposed blade may be brought into cutting contact with either or both shells and/or the insert and, in that event, package damage is likely to occur. In the embodiment of FIGS. 1–4, such resisting means advantageously comprises a rib 54 integral with the rear shell 20, and extending transversely linearly across the entire width of the package and, more particularly, across the flat of the exposed blade 14. The rib 54 is advantageously of a generally flattened, U-shaped cross-section, although other cross-sections could equally well be employed. The cross-section of rib 54 is constant across the package, although this is not critical. The rib 54, in effect, acts as a stiffener for the package to oppose the aforementioned external forces. The rib 54 abuts against the blade 14 and steadies the same to oppose its displacement, particularly in a direction out of the plane of the insert 28.

Figure 4:
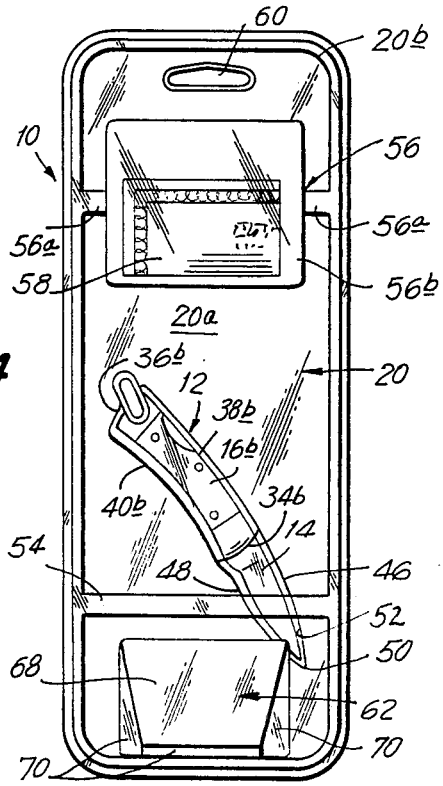
FIG. 4 is a rear view of the package of FIG. 1.

Another rib 56 extends transversely across the entire width of the package. As shown in FIG. 4, rib 56 does not have a constant cross-section, but, instead, has a pair of rib end portions 56a of relatively narrow, generally flattened, U-shaped cross-section similar to that described and illustrated in connection with rib 54 and, in fact, extending parallel to rib 54, as wall as a central enlarged portion 56b located between the end portions 56a. Central portion 56b bounds a compartment, again of generally flattened, U-shaped cross-section, in which sheet material 58 may advantageously be inserted, preferably in folded form. Sheet material 58 may be warranty information, instructions for use, a loss replacement certificate, a money-back coupon, etc., and, in short, virtually anything which the knife manufacturer wishes to provide to the purchaser.

The package and the knife are supported in a generally upright display condition and, for this purpose, the package 10 is provided with a hang-up hole 60 extending through the shells 18, 20 and the insert. The walls bounding the hole 60 are sealed, preferably with a heat seal. The hole is large enough to receive with clearance a support rod such as a hook, so that the package 10 may be suspended from the rod in a vertical orientation.

The knife 12 may also be displayed in the upright manner shown in FIG. 3 wherein a base 62 of generally triangular cross-section is formed integrally with the rear shell 20. The base 62 has a generally planar bottom portion 64 adapted to engage a horizontal support surface 66 such as a counter top, and a brace portion 68 extending rearwardly from the main shell portion 20*a* below the rib 54 to the rear of the bottom portion 64. Side portions 70 extend between the base 64 and base 68 portions to bound a compartment which not only serves as a package stiffener, but also serves as a convenient compartment in which an article may be contained. For example, the sheet material 58, or additional sheet material, or some other article, e.g. replacement blades, may be inserted in the base compartment. It will be observed that the interior of the base and sheet material compartments are visible so that the purchaser may not only inspect their contents, but also both sides of the knife without exposing himself to injury, and while assuring himself that the entire contents of the package are present.

Figure 7:
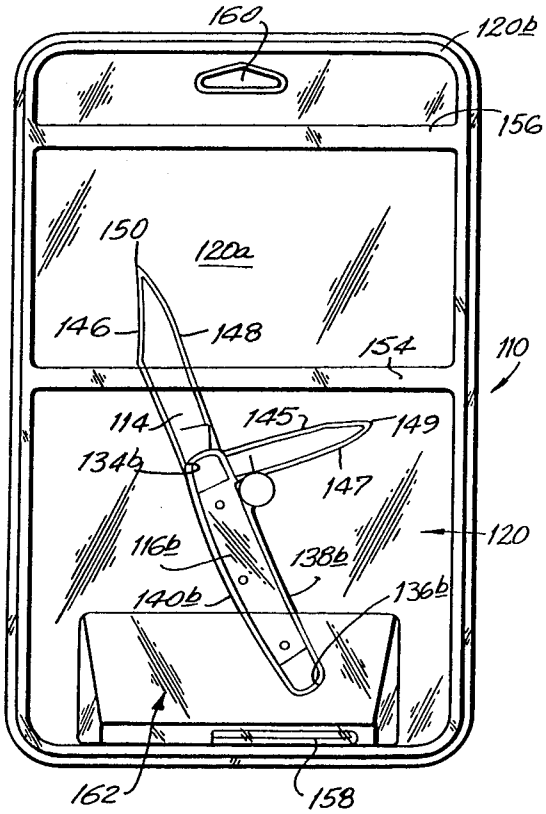
FIG. 7 is a rear view of the package of FIG. 5.
Figure 6:
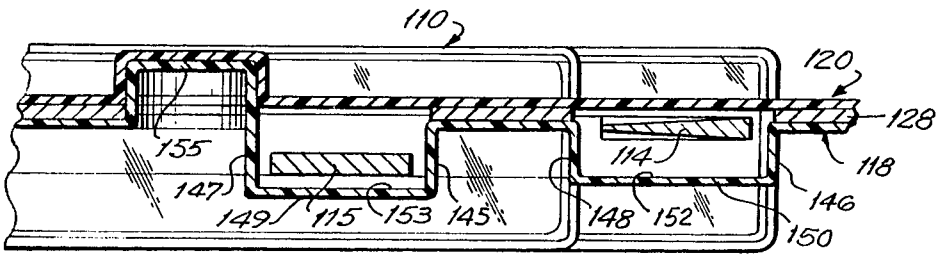
FIG. 6 is an enlarged sectional view taken along line 6—6 of FIG. 5.
Figure 5:
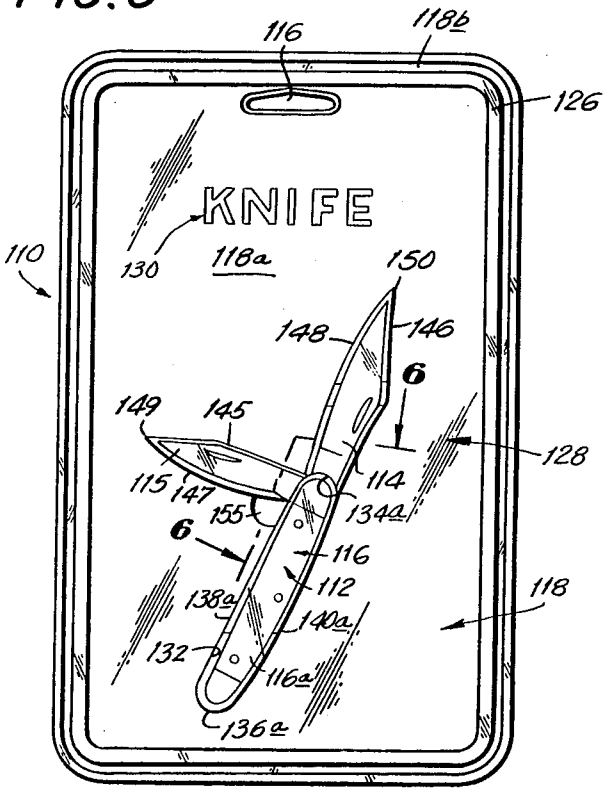
FIG. 5 is a front view of a knife transport/display package in accordance with another embodiment of this invention.

Turning now to the embodiment of FIGS. 5–7, like parts have been identified wherever possible, with the number 100 added to the same reference numerals used in the embodiment of FIGS. 1–4 to simplify the description. Thus, the package 110 contains a knife 112 having an exposed blade 114 pivotably mounted to a handle 116 composed of two handle parts 116*a*, 116*b*. In contrast to the previous embodiment, the knife 112 has a second exposed blade 115 pivotably mounted to the handle 116, and shown positioned in an approximately half-opened position, i.e. midway between the fully-opened position as exemplified by the position occupied by blade 114, and the non-illustrated fully-concealed position in which the cutting edge of the blade 115 is concealed within the handle. The double-bladed folding knife 112 is contained between front and rear shells 118, 120, respectively having main portions 118*a*, 120*a*, and peripheral edge portions 118*b*, 120*b*. Raised border 126 surrounds front main portion 118*a*. Indicia 130 are provided on a generally planar insert 128 sandwiched between the shells 118, 120.

Handle compartment 132 is formed by front handle-confining walls 134*a*, 136*a*, 138*a*, 140*a* which closely confine front handle part 116*a*, and by rear handle-confining walls 134*b*, 136*b*, 138*b*, 140*b* which closely confine rear handle part 116*b*.

Blade compartment 152 is formed by front blade-confining walls 146, 148, 150. In addition to blade compartment 152, a second blade compartment 153 is formed by front blade-confining walls 145, 147, 149. Blade 115 is closely confined against displacement within its compartment 153, but, for added safety, a stop 155 is formed integrally with at least one of the shells, and is located adjacent the cutting edge of the blade 115 in the vicinity of the tang of the blade 115. The stop 155 projects into the path of pivoting movement of the blade 115 between its opened and closed positions. In the event that the folding blade 115 is subjected to external forces which tend to move the blade 115 from its midway position toward its closed position, then the stop 155 abuts the blade 115 and prevents such movement.

Rib 154 extends linearly and transversely across the flat of blade 114. In contrast to the previous embodiment, rib 154 is not located at the lower regions of the package adjacent the base, but, instead, is located slightly above the center of the package. This indicates that the orientation of the knife, i.e. with the blade tip pointing up or down, is not critical to this invention.

Rib 156 has a constant cross-section, in contrast to rib 56 of the previous embodiment. Hence, the sheet material 58, which was previously inserted in the enlarged central rib compartment 56*b*, can now be inserted within the interior of the base 162, as previously suggested. This is shown by sheet material 158 in FIG. 7, which is loosely received within the base 162. The base 162 or the hang-up hole 160 can be employed to display the knife 112 in a generally upright display condition.

Turning now to the embodiment of FIGS. 8–10, like parts with the embodiment of FIGS. 1–4 have been identified wherever possible with the number 200 added to the same reference numerals used in the embodiment of FIGS. 1–4 in order to simplify the description.

Thus, the package 210 contains a folding-blade knife 212 having an exposed blade 214 pivotably mounted to a handle 216 composed of two handle parts 216*a*, 216*b*. The illustrated knife 212 is a folding fillet knife with the exposed blade 214 shown positioned in a partially-open position, i.e. somewhere between the half-open position and the fully-concealed position. The folding knife 212 is contained between front and rear shells 218, 220, respectively having main portions 218*a*, 220*a*, and edge portions 218*b*, 220*b*. Raised border 226 surrounds front main portion 218*a*. An insert 228 is mounted between the shells 218, 220, and indicia 230 may be provided on one or both sides of the insert 228.

Handle compartment 232 is formed by front handle-confining walls 234*a*, 236*a*, 238*a*, 240*a* which closely confine front handle part 216*a*, and by rear handle-confining walls 234*b*, 236*b*, 238*b*, 240*b* which closely confine rear handle part 216*b*.

Blade compartment 252 is formed by front blade-confining walls 246, 248, 250. Partially-open blade 214 is closely confined against displacement within its compartment 252, but, for added safety, a stop 255, analogous to the aforementioned stop 155, is formed integrally with at least one of the shells, and located adjacent the cutting edge of the blade 214 in the vicinity of the tang of the blade. The stop 255 projects into the path of pivoting movement of the blade 214. In the event that the blade 214 is displaced toward its closed position, then the stop prevents such movement by abutment therewith. Due to the provision of the stop 255, a rib corresponding to rib 54 or 154 is not necessary.

Rib 256, having rib end portions 256*a* of narrow cross-section, and a central enlarged compartment 256*b* of much larger cross-section, is provided on the rear shell 220. In contrast to the previous embodiments, the central enlarged rib compartment 256*b* receives not sheet material such as sheet material 58, but, instead, closely confines a sheath 265 for the knife 212. As shown in FIGS. 8–10, the sheath has a generally rectangular outline, and is received in a corresponding cutout 266 formed in the insert 228. The sheath 265 is elongated, and is so positioned on the package so as to extend transversely across the handle 216 and the blade 214. In this way, the sheath also serves to stiffen the package and resist the aforementioned external forces tending to displace the knife. Central compartment 256*b* extends into the interior of base 262 in which folded sheet material 258 is also accommodated. The base 262 or the hang-up hole 260 can be used to display the knife 212 in a generally upright display condition.

Figure 13:
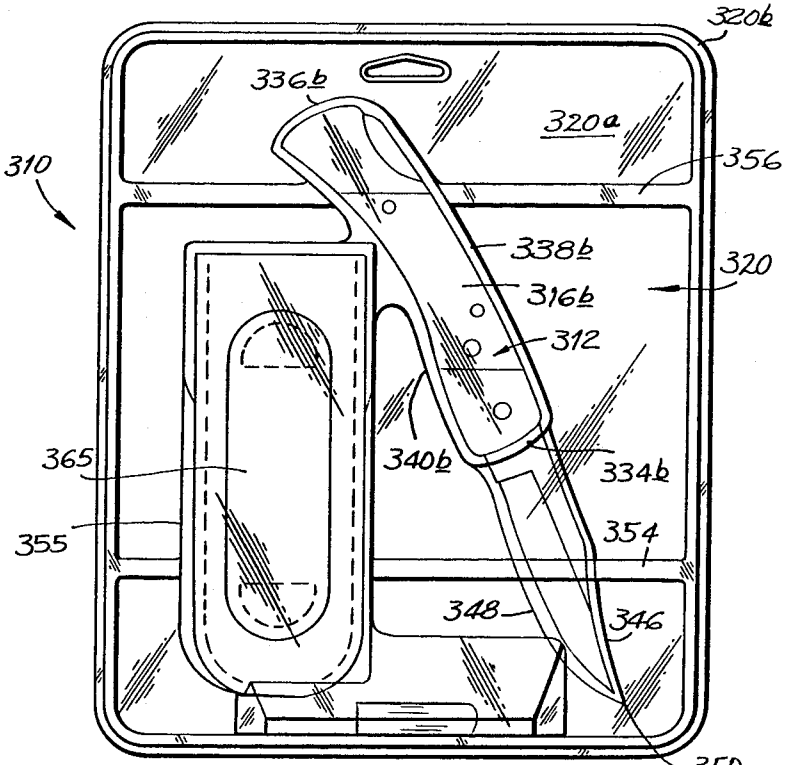
FIG. 13 is a rear view of the package of FIG. 11.
Figure 11:
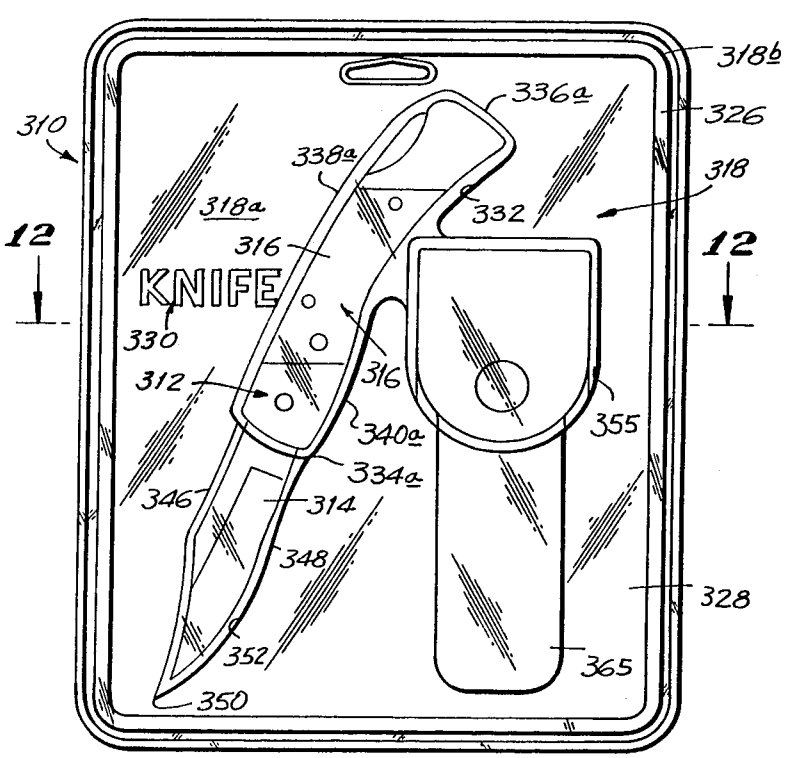
FIG. 11 is a front view of a knife transport/display package of yet another embodiment of this invention.
Figure 12:
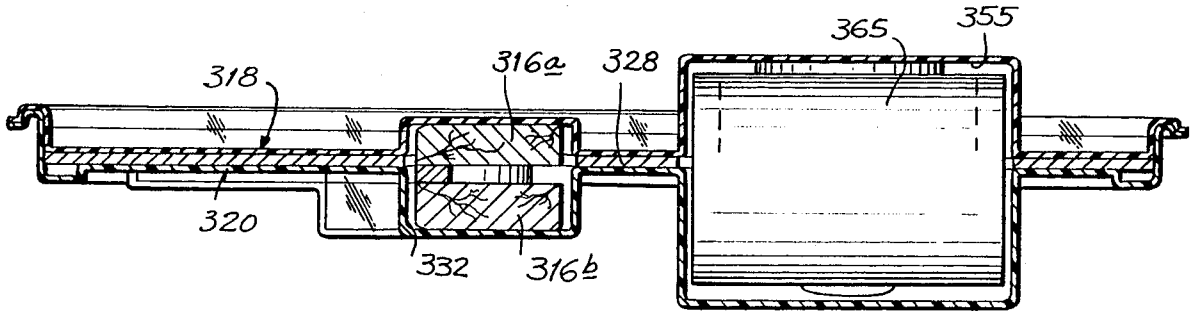
FIG. 12 is an enlarged sectional view taken along line 12—12 of FIG. 11.

Turning, finally, to the embodiment of FIGS. 11–13, like parts with those previously used with the embodiment of FIGS. 1–4 have been identified wherever possible with the number 300 added to the same reference numerals used in the embodiment of FIGS. 1–4 to simplify the description.

Thus, package 310 contains a knife 312 having an exposed blade 314 pivotably mounted to a handle 316 composed of two handle parts 316*a*, 316*b*. The blade 314 is shown in the fully-opened position. The folding knife 312 is contained between front and rear shells 318, 320, respectively having main portions 318*a*, 320*a*, and peripheral edge portions 318*b*, 320*b*. Raised border 326 surrounds front main portion 318*a*. An insert 328 is sandwiched between the shells 318, 320, and may be provided on one or both sides with indicia 330.

Handle compartment 332 is formed by front handle-confining walls 334*a*, 336*a*, 338*a*, 340*a* which closely confine front handle part 316*a*, and by rear handle-confining walls 334*b*, 336*b*, 338*b*, 340*b* which closely confine rear handle part 316*b*.

Blade compartment 352 is formed by front blade-confining walls 346, 348, 350 which closely confine blade 314 against displacement within its compartment. Rib 354 extends linearly across the flat of blade 314.

In contrast to the previous embodiment, rib. 354 is not of constant crdss-section, but, instead, has an enlarged compartment 355 in which a sheath 365 is closely confined. Rib 356 is likewise different from that described previously, in that rib 356 extends linearly transversely across the width of the handle from one side of the package to the other. Hence, not only is the blade steadied by the rib 354, but the handle 316 is steadied by the rib 356.

Another difference between the embodiment of FIGS. 11–13 and that of FIGS. 8–10 is that the sheath 365 is not positioned on the package in a direction transverse to that of the knife, but, instead, is positioned in a side-by-side relationship with that of the knife. The compartment 355 for the sheath advantageously intersects the handle compartment. It will be observed from FIG. 12 that the sheath 365 is symmetrically mounted on the package; that is, approximately half of the sheath extends forwardly of the insert 328, and the other half of the sheath extends rearwardly of the insert. This is in contrast to the embodiment of FIGS. 8–10 wherein the sheath compartment is situated solely rearwardly of the rear shell.

It will be understood that each of the elements described above, or two or more together, also may find a useful application in other types of constructions differing from the types described above.

For example, the knife handle may be made of wood, metal, plastic or similar materials, and the blade may be made of any hard material which can be honed. The handle and blade compartments may be formed on either the front and/or rear shells, and the same is true for the sheath compartment. Any one particular package may have one or more ribs, one of which may advantageously extend across the blade,and/or the handle, and/or the sheath if one is provided.

While the invention has been illustrated and described as embodied in a knife transport/display package, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A utensil transport/display package, comprising:
(a) a utensil having an exposed working part and a handle;
(b) a pair of synthetic plastic material shells having main shell portions spaced apart from each other to bound a space in which the utensil with the exposed working part is received, and shell edge portions peripherally bounding the main shell portions and peripherally sealed together;
(c) a generally planar insert mounted within the space;
(d) handle-confining walls on at least one of the main shell portions and being offset from the plane of the insert, said handle-confining walls bounding a handle compartment in which the handle is received;
(e) working-part-confining walls on at least one of the main shell portions and being offset from the plane of the insert, said working-part-confining walls bounding a working part compartment in which the exposed working part is received;
(f) at least one of the main shell portions being light-transmissive to enable a view to view the utensil with the exposed working part; and
(g) means for resisting external forces tending to effect relative displacement between the utensil and the shells to cause damage to the shells, said resisting means including a rib integral with one of the shells and extending transversely across the utensil, said rib abutting the utensil in a plane generally parallel to the planar insert to oppose said displacement.

2. A knife transport/display package, comprising:
(a) a knife having an exposed elongated blade and a handle;
(b) a pair of synthetic plastic material shells having main shell portions spaced apart from each other to bound a space in which the knife with the exposed blade is received, and shell edge portions peripherally bounding the main shell portions and peripherally sealed together;
(c) a generally planar insert mounted within the space;
(d) handle-confining walls on at least one of the main shell portions and being offset from the plane of the insert, said handle-confining walls bounding a handle compartment in which the handle is received;
(e) blade-confining walls on at least one of the main shell portions and being offset from the plane of the insert, said blade-confining walls bounding a blade compartment in which the exposed blade is received;

(f) at least one of the main shell portions being light-transmissive to enable a viewer to view the knife with the exposed blade; and (g) means for resisting external forces tending to effect relative displacement between the knife and the shells to cause damage to the shells, said resisting means including a rib integral with one of the shells and extending transversely across the exposed elongated blade, said rib abutting the knife in a plane generally parallel to the planar insert to oppose said displacement.

3. The package as recited in claim 2, wherein the one shell has opposite lateral sides, and wherein the rib extends entirely from one to the other of the sides of the one shell.

4. The package as recited in claim 2, and further comprising supporting means includes walls bounding a hang-up hole extending through the shells and sealed about the hang-up hole, said hang-uphole accommodating with clearance a support rod inserted therethrough for suspending the package on the rod.

5. The package as recited in claim 2, wherein said one transparent main shell portion faces the viewer, and wherein the other main shell portion which faces away from the viewer is also constituted of a light-transmissive material to enable the viewer to view opposite sides of the handle and the exposed blade.

6. The package as recited in claim 5, wherein the handle-confining walls are provided on both main shell portions, and wherein the blade-confining walls are provided only on one of the main shell portions.

7. The package as recited in claim 6, wherein the handle-confining walls on said one main shell portion merge continuously with the blade-confining walls thereon.

8. The package as recited in claim 2; and further comprising a knife sheath between the shells, and sheath-receiving walls on at least one of the main shell portions and being offset from the plane of the insert, said sheath-receiving walls bounding a sheath compartment having a complementary contour to that of the sheath for closely confining the sheath between the shells, thereby opposing sheath displacement within the space.

9. The package as recited in claim 2, wherein the knife is of the folding type and has the blade mounted on the handle for movement between a closed position in which the cutting edge of the blade is concealed, and an open position in which the cutting edge of the blade is exposed; and further comprising means for resisting external forces tending to move the blade relative to the handle.

10. The package as recited in claim 2, wherein the insert has indicia relating to the knife, said indicia being visible together with the knife through the light-transmissive one of the main shell portions.

11. The package as recited in claim 2, wherein the handle compartment has a complementary contour to that of the handle for closely confining the handle in the handle compartment.

12. The package as recited in claim 2, wherein the blade compartment has a complementary contour to that of the exposed blade for closely confining the exposed blade in the blade compartment.

13. The package as recited in claim 2, wherein the insert has a kinfe-receiving cutout having a complementary outline to that of the handle and the exposed blade.

14. The package as recited in claim 2; and further comprising means for supporting the knife in a generally upright display condition.

15. A knife transport/display package, comprising:

(a) a knife having an exposed blade and an elongated handle;

(b) a pair of synthetic plastic material shells having main shell portions spaced part from each other to bound a space in which the knife with the exposed blade is received, and shall edge portions peripherally bounding the main shell portions and peripherally sealed together;

(c) a generally planar insert mounted within the space;

(d) handle-confining walls on at least one of the main shell portions and being offset from the plane of the insert, said handle-confining walls bounding handle compartment in which the handle is received;

(e) blade-confining walls on at least one of the main shell portions and being offset from the plane of the insert, said blade-confining walls bounding a blade compartment in which the exposed blade is received;

(f) at least one of the main shell portions being light-transmissive to enable a viewer to view the knife with the exposed blade; and (g) means for resisting external forces tending to effect relative displacement between the knife and the shells to cause damage to the shells, said resisting means including a rib integral with one of the shells and extending transversely across the elongated handle, said rib abutting the knife in a plane generally parallel to the planar insert to oppose said displacement.

16. A knife transport/display package, comprising:

(a) a knife having an exposed blade and a handle;

(b) a pair of synthetic plastic material shells having main shell portions spaced apart from each other to bound a space in which the knife with the exposed blade is received, and shell edge portions peripherally bounding the main shell portions and peripherally sealed together, said sealed shells having a width;

(c) a generally planar insert mounted within the space;

(d) handle-confining walls on at least one of the main shell portions and being offset from the plane of the insert, said handle-confining walls bounding a handle compartment in which the handle is received;

(e) blade-confining walls on at least one of the main shell portions and being offset from the plane of the insert, said blade-confining walls bounding a blade compartment in which the exposed blade is received;

(f) at least one of the main shell portions being light-transmissive to enable a view the knife with the exposed blade; and (g) means for resisting external forces tending to effect relative displacement between the knife and the shells to cause damage to the shells, said resisting means including a rib integral with one of the shells and extending transversely across the width of the sealed shells, said rib abutting the knife in a plane generally parallel to the planar insert to oppose said displacement.

17. A knife transport/display package, comprising:
(a) a knife having an exposed blade and handle;
(b) a pair of synthetic plastic material shells having main shell portions spaced apart from each other to bound a space in which the knife with the exposed blade is received, and shell edge portions peripherally bounding the main shell portions and peripherally sealed together;
(c) a generally planar insert mounted within the space;
(d) handle-confining walls on at least one of the main shell portions and being offset from the plane of the insert, said handle-confining walls bounding a handle compartment in which the handle is received;
(e) blade-confining walls on at least one of the main shell portions and being offset from the plane of the insert, said blade-confining walls bounding a blade compartment in which the exposed blade is received;
(f) at least one of the main shell portions being light-transmissive to enable a viewer to view the knife with the exposed blade; and
(g) means for resisting external forces tending to effect relative displacement between the knife and the shells to cause damage to the shells, said resisting means including a stop integral with one of the shells and located adjacent the exposed blade, said stop projecting into the path of the blade displacement caused by said external forces.

18. A knife transport/display package, comprising:
(a) a knife having an exposed blade and a handle;
(b) a pair of synthetic plastic material shells having main shell portions spaced apart from each other to bound a space in which the knife with the exposed blade is received, and shell edge portions peripherally bounding the main shell portions and peripherally sealed together;
(c) a generally planar insert mounted within the space;
(d) handle-confining walls on at least one of the main shell portions and being offset from the plane of the insert, said handle-confining walls bounding a handle compartment in which the handle is received;
(e) blade-confining walls on at least one of the main shell portions and being offset from the plane of the insert, said blade-confining walls bounding a blade compartment in which the exposed blade is received;
(f) means for supporting the knife in a generally upright display condition, said supporting means including a base integral with one of the shells, and operative for supportably displaying the knife within the sealed shells above a generally horizontal support surface; and
(g) at least one of the main shell portions being light-transmissive to enable a viewer to view the knife with the exposed blade in the display condition of the knife.

19. The package as recited in claim 18, wherein the base bounds a sheet material compartment in which sheet material is inserted.

* * * * *